United States Patent [19]

Harrel

[11] Patent Number: 4,605,159

[45] Date of Patent: Aug. 12, 1986

[54] REINFORCED BOX STRUCTURE

[76] Inventor: Gad J. Harrel, 119 Wilson Rd., Dollard des Ormeaux, Quebec, Canada

[21] Appl. No.: 713,804

[22] Filed: Mar. 20, 1985

[30] Foreign Application Priority Data

Mar. 29, 1984 [CA] Canada ..... 450811

[51] Int. Cl.[4] ..... B65D 5/00; B65D 81/02

[52] U.S. Cl. ..... 229/116; 206/436; 206/594

[58] Field of Search ..... 229/22; 206/521, 591, 206/594, 436, 499

[56] References Cited

U.S. PATENT DOCUMENTS

| | | | |
|---|---|---|---|
| 204,441 | 6/1878 | Marshall | 229/22 |
| 2,735,606 | 2/1956 | Paige | 206/521 |
| 2,790,588 | 4/1957 | Deeren | 206/594 |
| 2,882,990 | 4/1959 | Mustoe | 229/22 |
| 3,136,413 | 6/1964 | Hall | 206/594 |
| 3,161,339 | 12/1964 | Weller | 206/521 |
| 3,261,461 | 7/1966 | Fontana | 229/22 |
| 3,303,929 | 2/1967 | Pace | 206/436 |
| 3,359,657 | 12/1967 | Hedberg | 229/22 |
| 3,666,607 | 5/1972 | Weissman | 229/22 |
| 3,889,866 | 6/1975 | Keller | 229/22 |
| 4,064,662 | 12/1977 | O'Toole | 229/22 |
| 4,191,324 | 3/1980 | Kitagawa | 229/22 |

FOREIGN PATENT DOCUMENTS

| | | | |
|---|---|---|---|
| 224005 | 3/1962 | Austria | 229/22 |
| 2237809 | 2/1975 | France | 229/22 |
| 355396 | 8/1961 | Switzerland | 229/22 |
| 305518 | 2/1929 | United Kingdom | 229/22 |

*Primary Examiner*—William Price
*Assistant Examiner*—Gary E. Elkins

[57] ABSTRACT

A reinforcing triangular container for a box enclosure. The container comprises a four sided hollow triangular enclosure formed of rigid material and defining six straight edges and four side walls. Securable opening means is provided for access to the interior of the triangular enclosure of positioning of an article therein. The triangular enclosure is dimensioned to be positioned in the box enclosure with at least some of the straight edges thereof in diagonal contact with a respective wall of the cardboard box while the side walls of the triangular enclosure are spaced inwardly of the walls of the box whereby an article positioned within the triangular enclosure is spaced from the side walls of the box while the box side walls in contact with the straight edges of the triangular enclosure are reinforced.

6 Claims, 9 Drawing Figures

REINFORCED BOX STRUCTURE

BACKGROUND OF INVENTION (a) Field of the Invention

The present invention relates to a reinforced box structure and more particularly to a triangular hollow container positionable within the box with edges only of the container being in contact with respective side walls of the box while the side walls of the container are spaced inwardly of the box side wall whereby articles positioned in the triangular container are spaced and protected from the box side walls.

(b) Description of Prior Art

In the shipping of fragile articles, often such articles become broken in their shipping container during transportation due to mishandling of the container due to improper packaging of the article within the container. Various prior art methods have been devised whereby to maintain such fragile articles immovable within the container and spaced from the side walls thereof. For example, these articles are mounted on support frames which are positioned in close fit within a box with the article being secured to the support frame to remain in spaced relation to the side walls of the box. The spaces within the box are then filled with material that will prevent any shifting of the article or the support frame within the box. Such box construction is expensive and time-consuming to assemble.

SUMMARY OF INVENTION

It is a feature of the present invention to provide a reinforced box structure which comprises a box enclosure having a reinforcing triangular inner container, the inner container being capable of supporting articles therein and in spaced relationship from the side walls of the box, while the side walls of the box are reinforced by edges of the triangular container.

Another feature of the present invention is to provide a reinforcing triangular container which is constructed from a single blank of cardboard or other rigid material and which is capable of containing articles therein and reinforce the side walls of a box enclosure when placed therein.

A still further feature of the present invention is to provide a reinforced box structure which is inexpensive to produce and easy to assemble while automatically positioning articles contained within a reinforced triangular container within a box enclosure spaced inwardly of the side walls of the box enclosure.

According to the above features, from a broad aspect, the present invention provides a reinforcing triangular container for a box enclosure. The container comprises a four sided hollow triangular enclosure formed of rigid material and defining six straight edges and four side walls. Securable opening means is provided for access to the interior of the triangular enclosure for positioning of an article therein. The triangular enclosure is dimensioned to be positioned in the box enclosure with at least some of the straight edges thereof in diagonal contact with a respective wall of the box while the side walls of the triangular enclosure are spaced inwardly of the walls of the box whereby an article positioned within the triangular enclosure is spaced from the side walls of the box while the box side walls in contact with the straight edges of the triangular enclosure are reinforced.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
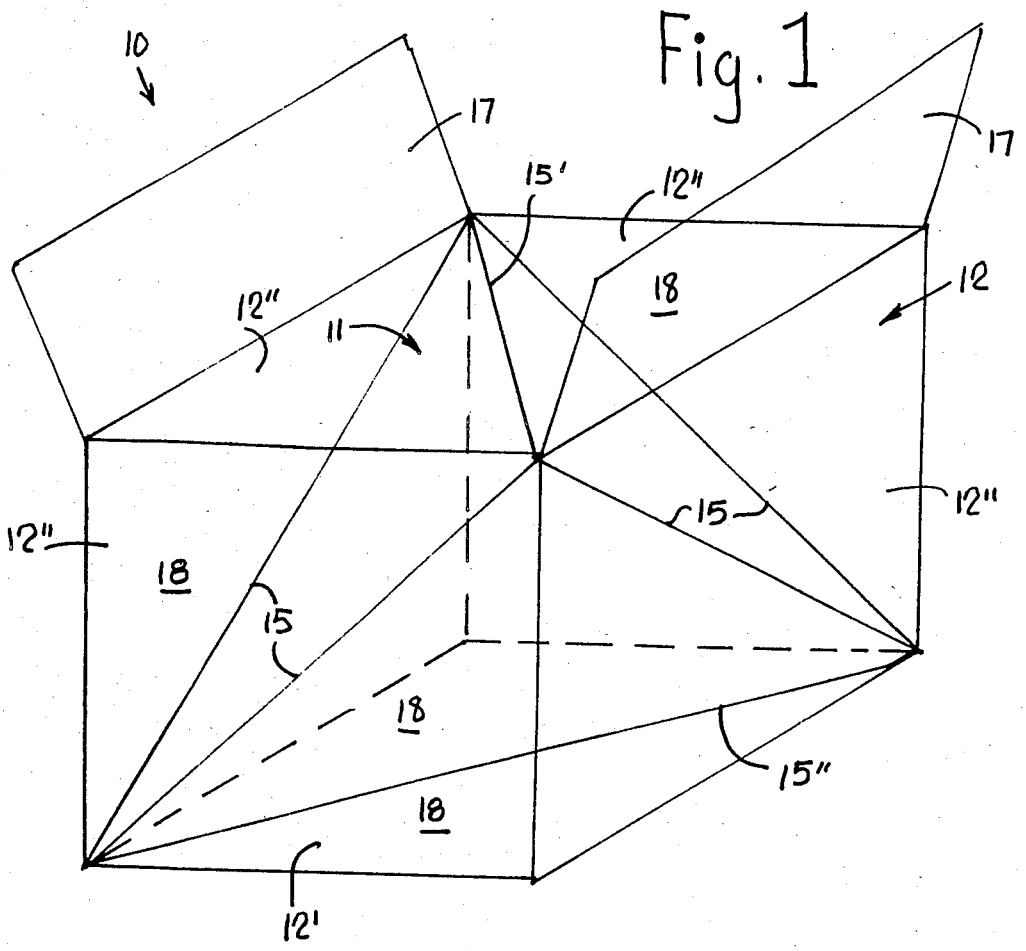
FIG. 1 is a perspective line drawing showing the combination of the triangular container and a box enclosure constituting the present invention.

Referring now to the drawings and more particularly to FIG. 1, there is shown generally at 10 the reinforced box structure of the present invention. The box structure consists of a reinforcing triangular container 11 disposed within a box enclosure 12.

Figure 3:
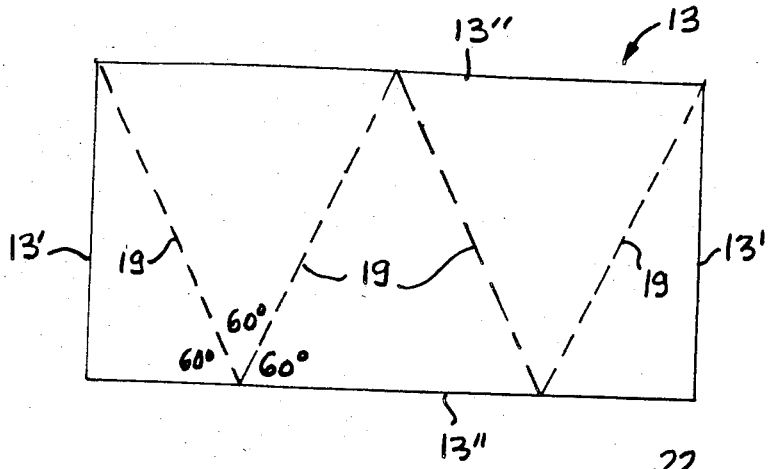
FIG. 3 is a plan view showing the blank forming the reinforcing triangular container.

The reinforcing triangular container is formed from a blank 13 of rigid foldable material (See FIG. 3), preferably but not exclusively formed of a cardboard material and bent to form a four sided hollow triangular enclosure. The enclosure defines four side walls 14 and six straight edges 15 delineating the side walls. The opposed end walls 13' of the blank are brought together and constitute securable opening means for access to the interior of the triangular enclosure for positioning in the enclosure articles such as fragile articles for shipping within the box enclosure 12. The end edges 13' are secured in planar relationship by means of an adhesive tape 16, or other means such as clips, staples, flaps or tabs, which tape also overlaps the side wall adjacent the base of the side wall 14'. Further fastening means 16' also secures the adjacent edges of side walls 14''.

As shown in FIG. 1, the triangular container 11 is disposed within a cubic box with the top edge 15' extending diagonally across the box opened end from opposite corners thereof. The bottom edge 15'' of the triangular container extends diagonally across the bottom wall 12' of the box transversely to the top edge 15'. When the flaps 17 of the box are closed, they form the top wall with the edge 15' extending diagonally against the top wall. As also shown, the other edges 15 of the triangular enclosure extend diagonally against a respective side wall 12'' of the box. Thus, the box enclosure 12 has every side wall, top and bottom wall reinforced by the triangular container with the side walls 14 of the container extending away from all of the walls of the box enclosure. Thus, articles positioned within the triangular container are spaced from the box side walls and protected from impact due to mishandling of the box enclosure during shipping.

As also shown in FIG. 1, once the triangular container 11 is positioned within the box, it defines four isolated storage areas 18 adjacent respective side walls of the triangular container. These isolated areas may also be used for the storage therein of articles which are not as fragile as the ones in the triangular container.

Figure 2:
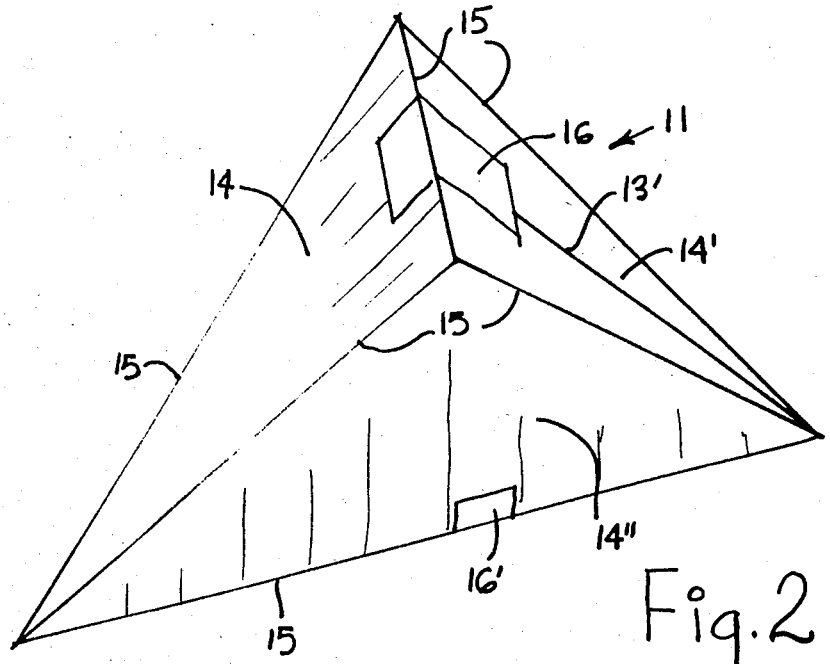
FIG. 2 is a perspective view showing the reinforcing triangular container.

Referring again to FIG. 3, the blank is formed from a rectangular sheet of rigid foldable material, such as cardboard. The blank defines opposed elongated parallel edges 13'' and opposed parallel end edges 13'. Two adjacent equilateral triangular shaped fold lines 19 are formed side by side along a respective half of one of the elongated parallel edges 13''. The blank is folded along the fold lines 19 to form the triangular enclosure as shown in FIG. 2. Closing tabs (not shown) may also be incorporated in the blank.

Figure 3A:
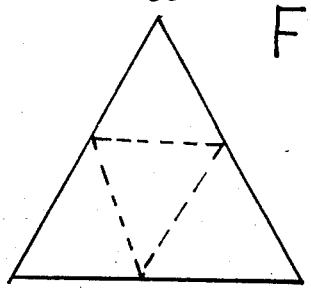
FIG. 3A is a plan view showing another blank forming the reinforcing triangular container.

FIG. 3A shows another embodiment of a blank forming the container 11. Its structure is evident from the drawing.

Figure 4:
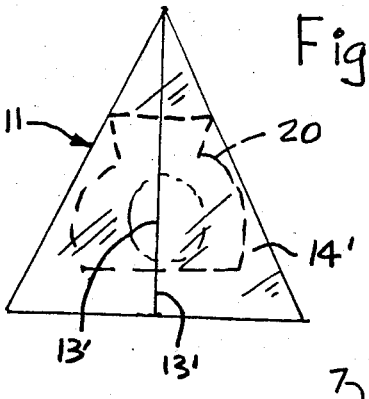
FIG. 4 is an end view of the reinforcing triangular container.
Figure 5:
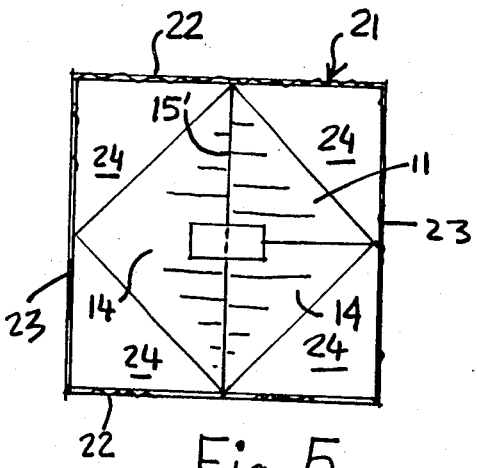
FIG. 5 is a top view showing the reinforcing triangular container positioned in a square box.

Referring now additionally to FIGS. 4 to 8, there is shown in FIG. 4, a fragile article 20 disposed within the triangular container 11. As shown in FIG. 5 the container 11 is shown disposed in a larger square box enclosure 21 with the top edge 15' of the enclosure 11 extending transverse and central across opposed parallel side walls 22 of the box 21. The bottom edge (not shown) extends transverse to the top edge 15' and perpendicular to the other opposed parallel side walls 23 of the box 21. With this type of arrangement there is formed within the box 21 larger storage areas 24 intermediate the side walls 14 of the triangular container and the side walls of the box 21.

Figure 6:
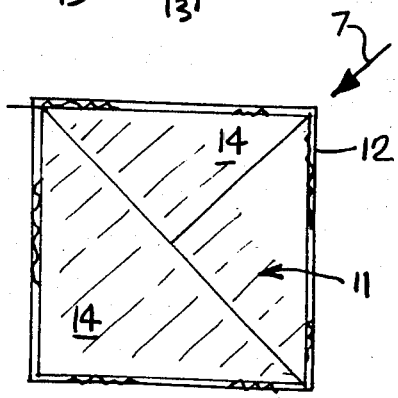
FIG. 6 is another view showing the reinforcing triangular container positioned in a cubic box but in a different manner from FIG. 1.
Figure 7:
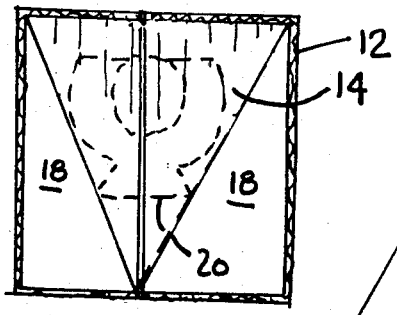
FIG. 7 is a fragmented side view showing the triangular container position as viewed in the direction of arrow 7 of FIG. 6.

FIG. 6 is a top view of FIG. 1 and shows the other alternative of positioning the triangular container 11 within the box enclosure 12. FIG. 7 is a fragmented view showing the location of the fragile article 20 within the container 11 with respect to the side walls of the box 12. It is also pointed out that with this triangular container there is no need to provide packing material in the interstitial areas within the box enclosure as the triangular container is immovably retained within the box.

Figure 8:
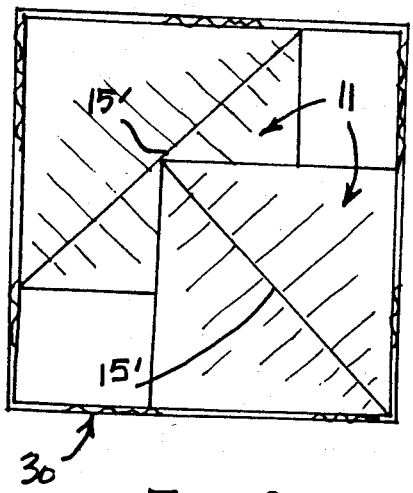
FIG. 8 is a top view showing two reinforcing triangular containers positioned in a box enclosure.

FIG. 8 shows still another alternative of packaging two triangular containers 11 within a box enclosure 30. As herein shown, four of the six straight edges of each container are in contact with a side wall of the box 30. The top and bottom transverse edges of the triangular enclosures are disposed in transverse relationship to like edges of the other of the triangular enclosure with one of the sides of each of the triangular enclosures in partial abutment. As shown, the two triangular containers are in close fit within the box with their top edge 15' lying in the same plane and in contact with the top wall (not shown) of the box 30.

It is within the ambit of the present invention to cover any obvious modifications of the preferred embodiment described herein provided such modifications fall within the scope of the appended claims.

I claim:

1. A reinforcing triangular container for a box enclosure, said container comprising a four sided hollow triangular enclosure formed of cardboard material and defining six straight edges and four side walls, securable opening means for access to the interior of said triangular enclosure for positioning articles therein, said triangular enclosure being dimensioned for positioning in said box enclosure with at least some of said straight edges in diagonal contact with a respective wall of said cardboard box to reinforce same while said side walls of said triangular enclosure are spaced inwardly of the walls of said box, there being two of said triangular enclosures in said cardboard box, four of said straight edges of each said triangular enclosure being in contact with a side wall of said cardboard box, each said triangular enclosure having a top and bottom transverse edge disposed in transverse relationship to like edges of the other of said triangular enclosures with one of said sides of each said triangular enclosure in partial abutment, said two triangular enclosure being arrested between said side walls of said box.

2. A container as claimed in claim 1 wherein each wall of said triangular enclosures is of equilateral triangular shape.

3. A container as claimed in claim 2 wherein said securable opening means is a slit along the hypotenuse of one of said walls of said triangular enclosures and a further slit along an adjacent base thereof.

4. A container as claimed in claim 3 wherein a fastening means secures said slit in closed condition.

5. A container as claimed in claim 4 wherein said fastening means is an adhesive tape.

6. A container as claimed in claim 1 wherein shock absorbing means is disposed inside said triangular enclosures intermediate said article and at least some of said side walls.

* * * * *